US005342192A

United States Patent [19]

Hirano

[11] Patent Number: 5,342,192

[45] Date of Patent: Aug. 30, 1994

[54] COOKING BURNER

[75] Inventor: Hideo Hirano, Nagoya, Japan

[73] Assignee: Meito Corporation, Nagoya, Japan

[21] Appl. No.: 91,599

[22] Filed: Jul. 15, 1993

[51] Int. Cl.[5] ..... F23Q 9/00

[52] U.S. Cl. ..... 431/284; 126/39 H

[58] Field of Search ..... 431/284, 285, 278, 354; 126/39 R, 39 H, 39 J, 39 E, 39 K

[56] References Cited

U.S. PATENT DOCUMENTS

| | | | |
|---|---|---|---|
| 2,935,128 | 5/1960 | Ferguson | 431/284 |
| 3,592,180 | 7/1971 | Kweller | 126/39 H |
| 3,748,082 | 7/1973 | Ivernel | 431/284 |

FOREIGN PATENT DOCUMENTS

| | | | |
|---|---|---|---|
| 62-18813 | 5/1987 | Japan . | |
| 2223302 | 4/1990 | United Kingdom | 431/284 |

*Primary Examiner*—James C. Yeung

*Attorney, Agent, or Firm*—Nikaido Marmelstein Murray & Oram

[57] ABSTRACT

A high cuisine burner capable of establishing a high heating power or temperature with a low combustion noise and adjusting the heating power easily. The burner comprises: an inner mixing tube for mixing combustible gas and air; a gas head fitted on the upper end of the inner mixing tube and having a plurality of inner flame holes; an air inlet tube arranged concentrically outside of the inner mixing tube and having a plurality of outer flame holes in the circumference of the upper end thereof; a device for blowing additional air into the air inlet tube; a gas head tube fixed on the outer side of the upper end portion of the air inlet tube; and an outer mixing tube extending from the gas head tube for mixing further combustible gas and air, whereby the additional air fed from the air inlet tube is blown between the outer flame holes and the inner flame holes. The burner may further comprise a flame hole cap fastened in the upper end of the gas head tube and having the plurality of outer flame holes.

2 Claims, 4 Drawing Sheets

COOKING BURNER

BACKGROUND OF THE INVENTION

1. Field of the Invention

The present invention relates to a burner to be used for cooking.

2. Description of the Prior Art

In the ordinary natural combustion burner, as is well known in the art, combustible gas is injected from an injection nozzle disposed at the inlet of a mixing tube to draw the air into the mixing chamber from an air suction port. The mixing tube is shaped as a "venturi tube" surrounding the injection nozzle with a converging cylinder so that the necessary amount of air is drawn in and the mixture of gases may be burned. The natural combustion burner produces a heating power or maximum temperature of about 800° C.

Chinese style cooking, however, requires a heating power or temperature of about 1,200° C. so that the water is sealed into the material being cooked, such as vegetables or meat. The forced combustion burner for a high heating power, according to the prior art, forces compressed air from a blower into the venturi tube so that the combustible gas and the compressed air may be mixed and burned coming out of the mixing tube.

The forced combustion burner of the prior art has a constant flame hole area (i.e., the total area of the plurality of flame holes of the gas head) and mixes the combustible gas and the air in the mixing tube. In case the heating power or temperature is to be adjusted, therefore, both the flow rate of gas to be injected from the injection nozzle and the flow rate of air to be fed into the mixing tube have to be regulated. The regulation of both of the flow rates is complicated and trouble-some. In addition, the heating power or temperature is difficult to adjust to a predetermined level for each time of regulating so that it cannot be finely controlled.

Moreover, the compressed air to be fed to the mixing tube is at a high pressure, and each flame hole has a small diameter so that the flames emanating from the flame holes produce high volume and/or frequency combustion sounds to cause a serious noise problem. A gourmet kitchen should be a calm working area, and the combustion sound of a burner is counter productive in this regard. Moreover, the forced combustion burner has to be equipped with regulators for the gas and air rates so that it has a complicated construction which raises a production cost.

SUMMARY OF THE INVENTION

The present invention is provided to solve the above-specified problems of the prior art.

According to a first aspect of the present invention, a burner is provided for feeding a mixture of combustible gas and air from a mixing tube to a gas head to inject the mixture of gases from a plurality of flame holes of the gas head, comprising: an inner mixing tube for mixing combustible gas and air; a gas head fitted on the upper end of the inner mixing tube and having a plurality of inner flame holes; an air inlet tube arranged concentrically outside of the inner mixing tube and having a plurality of outer flame holes in the circumference of the upper end thereof; a gas head tube fixed on the outer side of the upper end portion of the air inlet tube; and an outer mixing tube extending from the gas head tube for mixing further combustible gas and air, whereby the additional air fed from the air inlet tube is blown from between the outer flame holes and the inner flame holes.

According to a second aspect of the present invention, a burner is provided for feeding a mixture of combustible gas and air from a mixing tube to a gas head to inject the mixture of gases from a plurality of flame holes of the gas head, comprising: an inner mixing tube for mixing combustible gas and air; a gas head fitted on the upper end of the inner mixing tube and having a plurality of inner flame holes; an air inlet tube arranged concentrically outside of the inner mixing tube; a gas head tube fixed on the outer side of the upper end portion of the air inlet tube; an outer mixing tube extending from the gas head tube for mixing further combustible gas and air; and a flame hole cap fastened on the upper end of the gas head tube and having a plurality of outer flame holes, whereby the additional air fed from the air inlet tube is blown from between the outer flame holes and the inner flame holes.

Thus, the burner of the present invention is equipped with outer flame holes and inner flame holes. The outer flame holes can be given a large effective area. As a result, the burner can perform three modes of combustion, i.e., combustion using only the outer flame holes having a relatively large area, combustion using only the inner flame holes having a relatively small area, and simultaneous combustion using both the outer and inner flame holes having the largest area. In addition, the burner can have its heating power or temperature easily adjusted through the inner flame holes and the outer flame holes merely by independently regulating the flow rates of the combustible gas to be injected into the inner mixing tube and the outer mixing tube, respectively.

The air to be fed from the air inlet tube has a relatively low pressure and is blown upward through a ring-shaped, annular gap between the air inlet tube and the gas head so that it does not cause a high combustion noise. The air thus fed from the air inlet tube is blown between the inner flame holes and the outer flame holes so that it is evenly fed to the inner and outer flame holes. As a result, any oxygen deficiency can be prevented at the individual flame holes to ensure complete combustion.

BRIEF DESCRIPTION OF THE DRAWINGS

Other objects and advantages of the present invention will become apparent from the following description to be made with reference to the accompanying drawings, in which.

DESCRIPTION OF THE PREFERRED EMBODIMENTS

Figure 1:
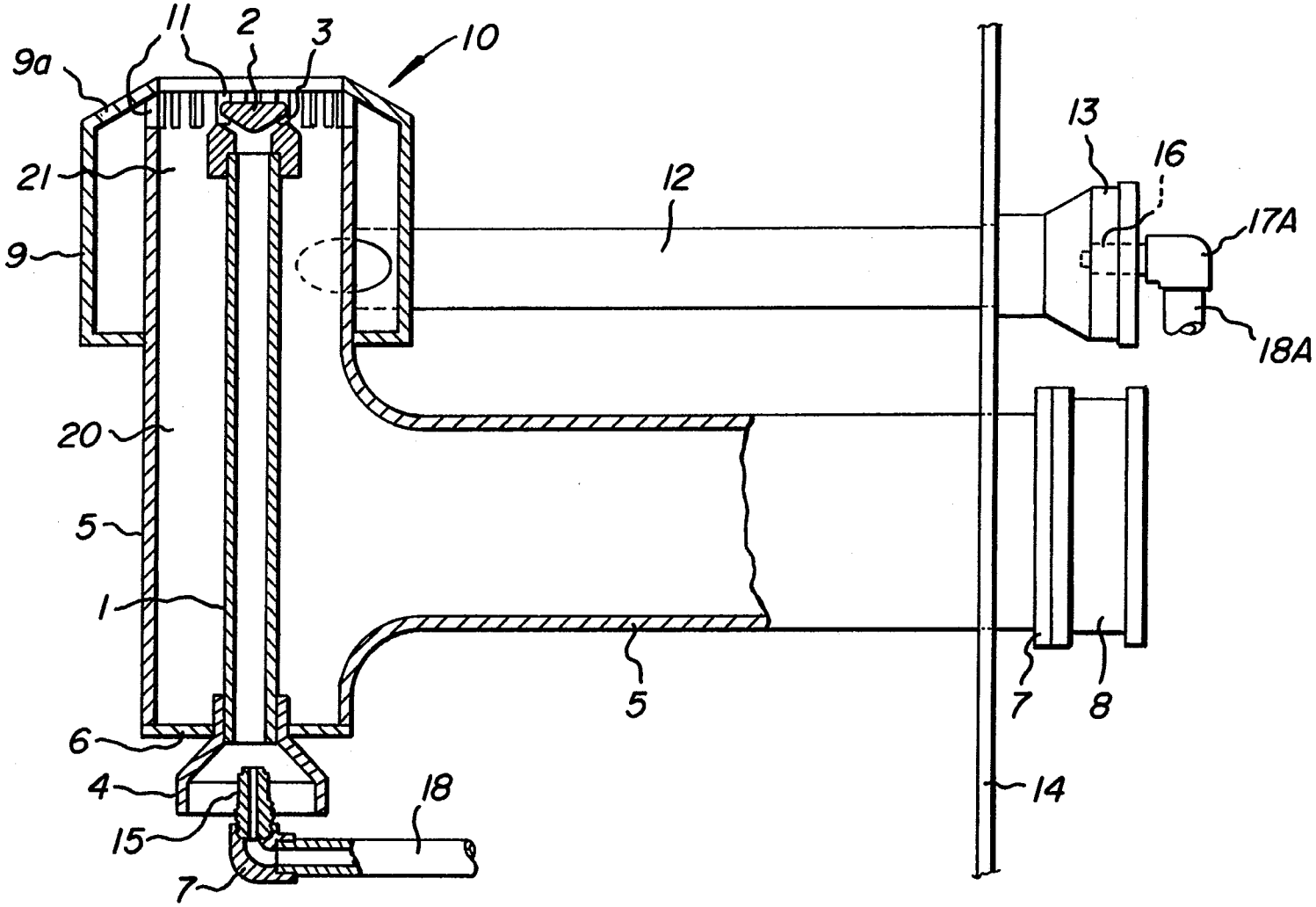
FIG. 1 is a sectional side elevation showing an essential portion of a burner according to a first embodiment of the present invention.
Figure 2:
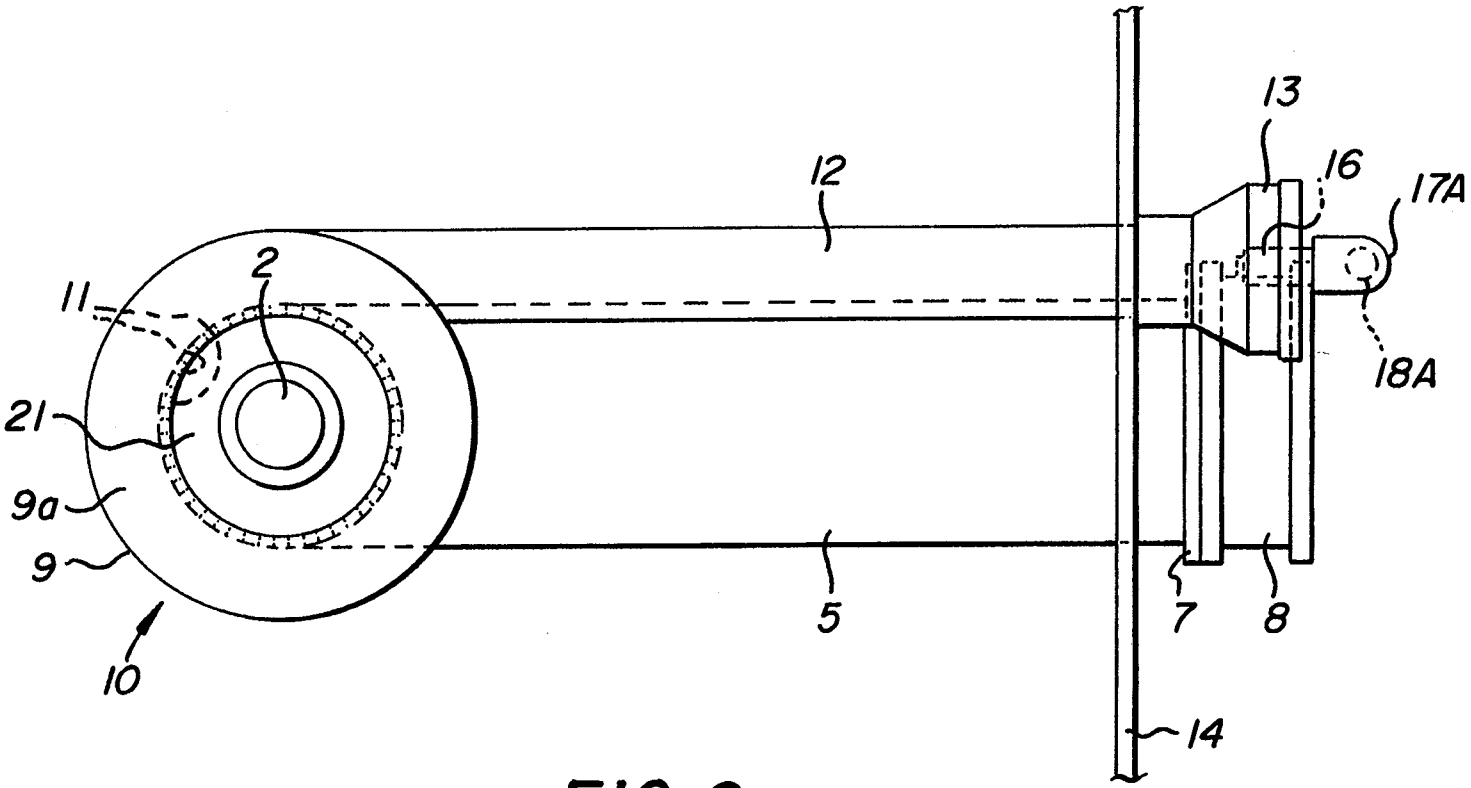
FIG. 2 is a top plan view showing the burner of FIG. 1.
Figure 3:
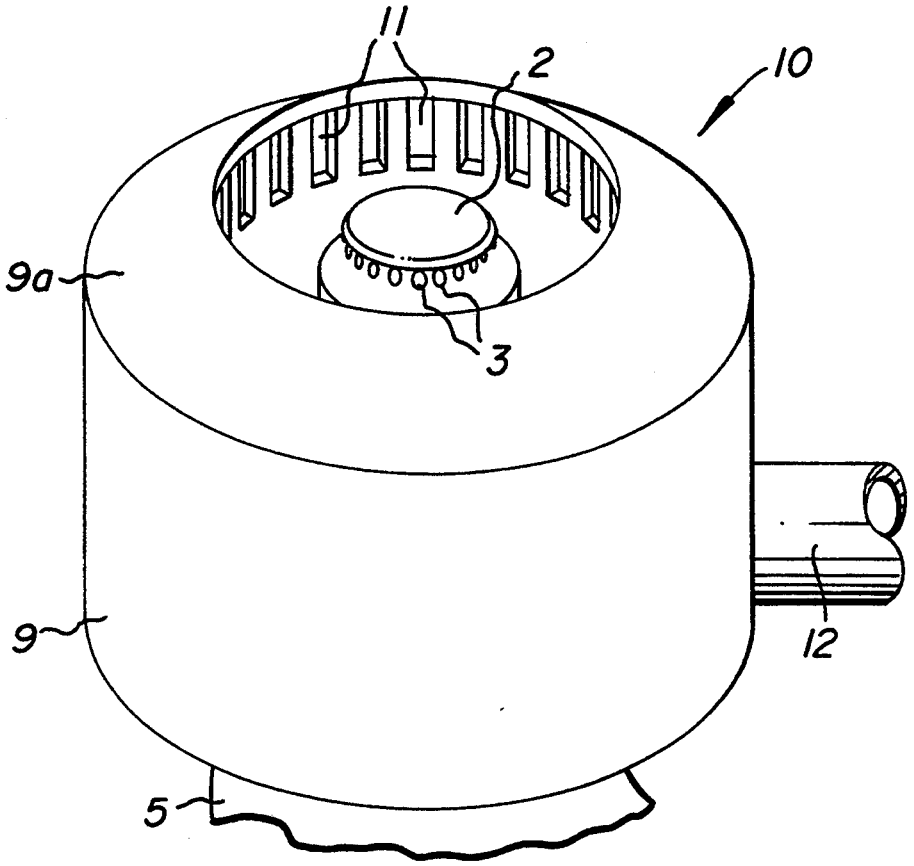
FIG. 3 is a perspective view showing the upper end portion of the air inlet tube of the burner of FIG. 1.

A burner 10 according to a first embodiment of the present invention is presented with reference to FIGS. 1 to 3. As shown in FIG. 1, a gas head 2 is fitted on the upper end of an inner mixing tube 1. The gas head 2 is formed with a plurality of inner flame holes 3 extending obliquely upwardly and outwardly in the radial directions. The inner mixing tube 1 is positioned vertically and has its lower end fitted in a converging venturi tube 4 which is fixed in the bottom plate 6 of an air inlet tube 5.

The air inlet tube 5 is prepared by forming a tube into substantially the shape of the letter "L". The air inlet tube 5 is concentrically arranged around the inner mixing tube 1 by welding it to the outer side of the tube 1. A small-sized blower 8 (which is exemplified by a propeller fan known under the trade name "Papst Fan") is attached to a flange 7 welded on the inlet end of the air inlet tube 5.

A gas head tube 9 is welded to the outer side of the upper end portion of the air inlet tube 5. The gas head tube 9 has a cover plate 9*a* slanted downwardly into a conical shape. The air inlet tube 5 has the circumference of its upper end cut to form a plurality of outer flame grooves so that the flame grooves form outer flame holes 11 when the inner circumference of the upper end of the cover plate 9*a* of the gas head tube 9 is held in abutment against the upper end of the air inlet tube 5. The gas head tube 9 and the air inlet tube 5 may be joined by fastening one into the other. The outer flame holes 11 are formed by cutting the upper end of the air inlet pipe 5 so that they can be given a large effective area.

An outer mixing tube 12 is tangentially branched from the lower portion of the gas head tube 9, as shown in FIG. 2. A converging outside venturi tube 13 is fitted at the leading end (as seen at the righthand side of FIG. 1) of the outer mixing tube 12.

The outer mixing tube 12 and the air inlet tube 5 are welded together to a side plate 14, which is attachable to a table or working surface so that the burner 10 is supported upright.

Gas injection nozzles 15, 16 are connected to gas pipes 18, 18A by elbows 17, 17A respectively. The gas pipes 18, 18A are supportable by the table or work surface. The combustible gas is injected from the gas injection nozzles 15 and 16 into the centers of the inner mixing tube 1 and the outer mixing tube 12, as is well known in the art. The series of the outer mixing tube 12, the gas injection nozzle 16, and the gas pipe 18A are given larger diameters so that they can feed more gas.

Figure 4:
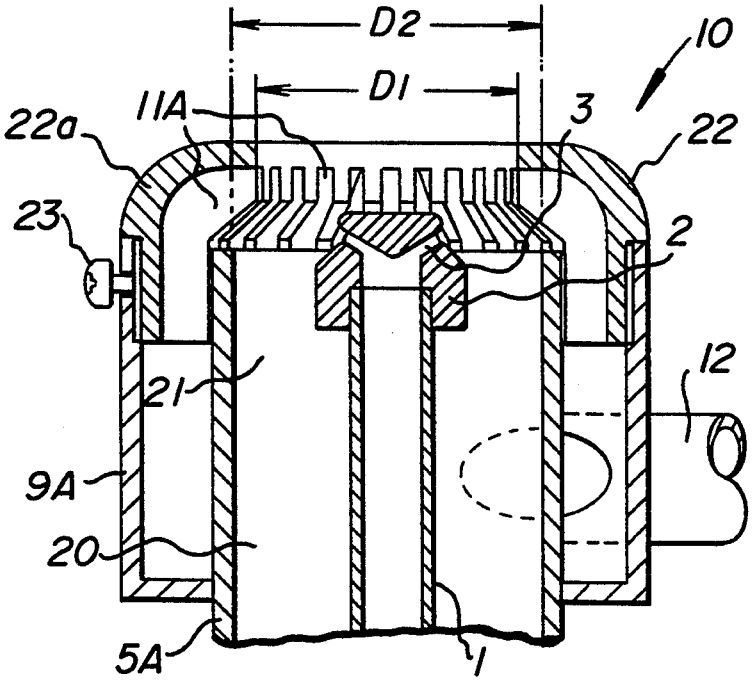
FIG. 4 is a partial sectional view showing an essential portion of a burner according to a second embodiment of the present invention.
Figure 5:
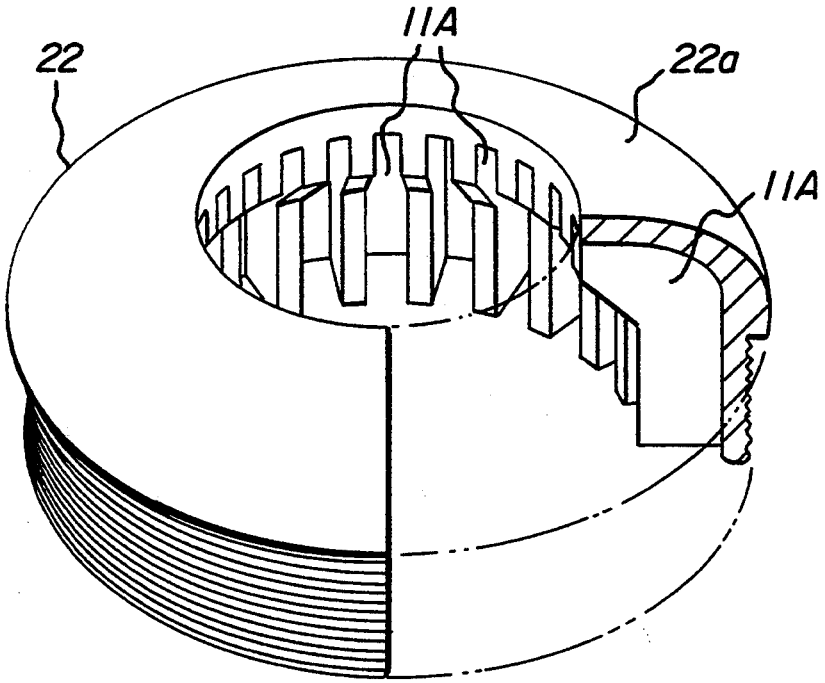
FIG. 5 is a partially cut-away perspective view showing the flame hole cap of the burner of FIG. 4.

As shown in FIGS. 4 and 5, the burner 10 according to a second embodiment of the present invention has outer flame holes 11A formed in a flame hole cap 22. This flame hole cap 22 is a ring-shaped cap fitted between a gas head tube 9A and the air inlet tube 5A. This ring-shaped cap is cast to have its inner circumference formed with a plurality of longitudinal grooves to provide the outer flame holes 11A and is externally threaded on its outer circumference leading to a cover plate portion 22*a*.

The flame hole cap 22 is fastened in internal threading formed in the inner circumference of the upper end portion of the gas head tube 9A. A set bolt 23 which is fastened in the gas head tube 9A is used to fix the flame hole cap 22. In the embodiment of FIG. 4, the internal diameter $D_1$ of the opening of the flame hole cap 22 is smaller than the internal diameter $D_2$ of the air inlet tube 5A. Thus, the flame hole cap 22 is fastened in the gas head tube 9A such that the cover plate portion 22*a* covers the upper end of the cylindrical air inlet tube 5A.

In this embodiment, the outer flame holes 11A can have their effective area increased, if the flame hole cap 22 has its fastening stroke reduced and is fixed by the set bolt 23. On the other hand, the effective area of the outer flame holes 11A can also be increased by cutting the flame hole cap 22 to have a suitable internal diameter $D_1$ as expressed by $D_1=D_2$. In short, the second embodiment is practically convenient because the effective area of the outer flame holes 11A can be controlled by adjusting the fastening stroke of the flame hole cap 22.

With the construction thus far described, the burner 10 of the present embodiment is operated by turning on the small-sized blower 8 to feed air into the L-shaped air inlet tube 5. Then, the air thus fed is blown via a passage 20 between the air inlet tube 5 or 5A and the inner mixing tube 1 upward from a large annular or ring-shaped gap 21 between the gas head 2 and the air inlet tube 5 or 5A. Since the air thus blown from the gap 21 is not mixed with the combustible gas, its flow rate need not be regulated when the heating power or temperature is to be adjusted.

If a control valve (not-shown) is opened to inject combustible gas from the injection nozzle 15, the combustion air is guided from the inner circumference into the inner mixing tube 1 by the ejector effect so that the combustion air is mixed with the combustible gas in the inner mixing tube 1. As a result, the rising mixture of gases is injected obliquely upward towards the outer circumference of the gas head 2 from the inner flame holes 3.

If further combustible gas is also injected from the injection nozzle 16, it is mixed with further combustion air guided from the inner circumference of the venturi tube 13 into the outer mixing tube 12. The mixture of gases is then injected into the gas head tube 9 to rise in the gas head tube 9. Then, the mixture of gases is guided by the inner circumference of the cover plate 9A or portion 22*a* of the flame hole cap 22 until it is injected obliquely upward towards the center.

Thus, if the mixtures of gases injected from the inner flame holes 3 and the outer flame holes 11 are simultaneously ignited, the additional air blown through the gap 21 is fed between the inner and outer flame holes 3 and 11 so that the mixture of gases are completely burned to maintain flames having a high heating temperature (of about 1,300° C.).

EXAMPLE

We have metered the heating temperature and calories of the burner 10 having the following specification:

Diameter of Inner Mixing tube 1: 22 mm
Diameter of Gas head 2: 38 mm
Diameter of Air Inlet Tube 5: 90 mm
Diameter of Gas Head Tube 9: 140 mm
Diameter of Outer Mixing Tube 12: 34 mm
Effective Area of Inner Flame Holes 3: 125 $mm^2$
Effective Area of Outer Flame Holes 11: 840 $mm^2$
Flow Rate of Burner 8: 1.6 $m^3$/min.

The results are tabulated in the following:

TABLE 1

| | Heating Power Temperature (°C.) | Calories (K cal/Hr) |
|---|---|---|
| Inner Flame Holes 3 only | 1,200–1,300 (800) | 3,500 (1,750) |
| Outer Flame Holes 11 only | 1,200–1,300 (800) | 22,000 (11,000) |

TABLE 1-continued

| | Heating Power Temperature (°C.) | Calories (K cal/Hr) |
|---|---|---|
| Simultaneous Use of Both Inner and Outer Holes | 1,200–1,300 (800) | 25,500 (12,250) |

Note:
Parenthesized numeral values indicate the heating power and the calories when the blower is not operated.

In the burner of the present invention, as has been described hereinbefore, combustion is effected by feeding additional air into the mixture of combustible gases and combustion air ejected from the inner flame holes and the outer flame holes, so that the burning noise can be reduced to provide a calm working area in the gourmet kitchen. The highest heating power is achieved by effecting simultaneous combustion at the inner and outer flame holes, and the heating powers of the inner and outer flame holes can be adjusted independently of each other by regulating their individual combustible gas flow rates. Thus, this easy heat power adjustment leads to economy of the energy consumption yet enabling the highest temperatures needed to be obtained.

In addition, the burner of the present invention has such a simple construction as can be manufactured at a reasonable cost. Another practical effect is that the present invention is excellent in economics.

What is claimed is:

1. A burner for feeding a mixture of combustible gas and combustion air from an inner mixing tube to a gas head so as to inject the mixture of gases from a plurality of flame holes of the gas head, comprising:

said inner mixing tube, with an upper end, for mixing combustible gas and combustible air;

said gas head being fitted on the upper end of said inner mixing tube and having said plurality of inner flame holes;

an air inlet tube, with a upper end and an outer side, arranged concentrically outside of said inner mixing tube and having a plurality of outer flame holes in the circumference of the upper end thereof;

means for blowing additional air into said air inlet tube, whereby the additional air fed from said air inlet tube is blown between said outer flame holes and said inner flame holes;

a gas head tube fixed on the outer side of the upper end portion of said air inlet tube; and an outer mixing tube extending from said gas head tube for mixing further combustion gas and further combustion air.

2. A burner for feeding a mixture of combustible gas and combustion air from an inner mixing tube to a gas head to inject the mixture of gasses from a plurality of flame holes of the gas head, comprising:

said inner mixing tube, with an upper end, for mixing combustible gas and combustible air;

said gas head being fitted on the upper end of said inner mixing tube and having a plurality of inner flame holes;

an air inlet tube, with a upper end and an outer side, arranged concentrically outside of said inner mixing tube;

means for blowing additional air into said air inlet tube;

a gas head tube, with an upper end, fitted on the outer side of the upper end portion of said air inlet tube;

an outer mixing tube extending from said gas head tube for mixing further combustible gas and combustible air; and a flame hole cap fastened on the upper end of said gas head tube and having a plurality of outer flame holes, whereby the additional air fed from said air inlet tube is blown between said outer flame holes and said inner flame holes.

* * * * *